US008464970B2

(12) United States Patent
Ceru et al.

(10) Patent No.: US 8,464,970 B2
(45) **Date of Patent: *Jun. 18, 2013**

(54) UNDER-SINK WASTE PROCESSING APPLIANCE

(75) Inventors: Scott J. Ceru, Stevensville, MI (US); Andrew Deakin, Oakland, CA (US); Suzanne G. Howard, San Francisco, CA (US); Martin J. Kay, San Francisco, CA (US); Peter Riering-Czekalla, Oakland, CA (US); Altay J. Sendil, Palo Alto, CA (US); Casey J. Tubman, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/326,804

(22) Filed: Dec. 15, 2011

(65) Prior Publication Data

US 2012/0085846 A1 Apr. 12, 2012

Related U.S. Application Data

(63) Continuation of application No. 12/643,171, filed on Dec. 21, 2009, now Pat. No. 8,100,352.

(51) Int. Cl.
*B02C 23/36* (2006.01)

(52) U.S. Cl.
USPC ..... 241/21; 241/23; 241/24.11; 241/46.014; 241/65; 241/100

(58) Field of Classification Search
USPC ..... 241/21, 23, 65, 46.013–46.016, 100, 241/24.11
See application file for complete search history.

(56) References Cited

U.S. PATENT DOCUMENTS

| | | | | |
|---|---|---|---|---|
| 3,874,006 | A | 4/1975 | Ritter | |
| 4,761,235 | A | 8/1988 | Haentjens | |
| 4,847,927 | A | 7/1989 | Blanc | |
| 5,127,587 | A | 7/1992 | Johnson | |
| 5,129,590 | A | 7/1992 | Shinya | |
| 5,176,825 | A | 1/1993 | Hadjis et al. | |
| 5,413,705 | A | 5/1995 | Tammera et al. | |
| 5,773,281 | A | 6/1998 | Ichikawa et al. | |
| 6,258,594 | B1 | 7/2001 | Nakaya | |
| 6,413,435 | B1 | 7/2002 | Kyles et al. | |
| 6,576,140 | B1 | 6/2003 | Batten | |
| 6,629,652 | B2 | 10/2003 | Batten | |
| 7,108,209 | B2 | 9/2006 | Kim | |
| 7,954,739 | B2 * | 6/2011 | Shin-Ya | 241/46.013 |
| 8,100,352 | B2 * | 1/2012 | Ceru et al. | 241/21 |
| 2007/0113329 | A1 | 5/2007 | Luk | |
| 2007/0113335 | A1 | 5/2007 | Luk | |
| 2007/0289058 | A1 | 12/2007 | Luk | |

FOREIGN PATENT DOCUMENTS

| | | | |
|---|---|---|---|
| AU | 2009206999 | A1 * | 7/2009 |
| JP | 2009172505 | A | 8/2009 |
| WO | 2009093639 | A1 | 7/2009 |

* cited by examiner

*Primary Examiner* — Mark Rosenbaum
(74) *Attorney, Agent, or Firm* — Jacquelyn R. Lin

(57) ABSTRACT

An under-sink waste processing appliance includes a waste separator which extracts liquid from organic waste and passes such extracted liquid to a residential drain line. The remaining solid, in the form of organic pulp, is dried in a dryer and deposited in a removable collection receptacle.

17 Claims, 5 Drawing Sheets

UNDER-SINK WASTE PROCESSING APPLIANCE

CROSS REFERENCE TO RELATED APPLICATION

This application is a continuation of U.S. patent application Ser. No. 12/643,171, filed Dec. 21, 2009, which is incorporated herein by reference in its entirety.

TECHNICAL FIELD

The present disclosure relates generally to waste processing appliances for use in a kitchen.

BACKGROUND

Operation of a domestic kitchen produces organic waste such as food scraps. Such waste is generally either thrown into a trash receptacle or passed through a garbage disposal located under the kitchen's sink. Some jurisdictions do not allow the use of garbage disposals with only unprocessed waste (i.e., uncut) being permitted in the municipal drain lines.

SUMMARY

An under-sink waste processing appliance is herein described. The appliance extracts liquid from organic waste and passes such extracted liquid to a residential drain line. The remaining solid, in the form of organic pulp, is dried and deposited in a removable collection receptacle.

According to one aspect, an apparatus for processing organic waste from a sink includes a waste separator having (i) a waste inlet coupled to a drain of the sink, (ii) a motor-driven cutter operable to cut organic waste received through the waste inlet, (iii) a liquid outlet for dispelling liquid extracted from organic waste during operation of the motor-driven cutter, and (iv) a pulp outlet for dispelling pulp extracted from organic waste during operation of the motor-driven cutter. The pulp outlet is fluidly isolated from the liquid outlet. A dryer is coupled to the waste separator. The dryer includes (i) a pulp inlet coupled to the pulp outlet of the waste separator, (ii) a drying chamber positioned to receive pulp advanced through the pulp inlet, (iii) a heating element operable to heat and dehydrate pulp positioned in the drying chamber to generate dried solid waste, and (iv) a dried waste outlet for dispelling dried solid waste from the drying chamber. A removable collection receptacle is positioned to receive dried solid waste expelled from the dried waste outlet of the dryer.

The motor-driven cutter may be embodied as an augur or one or more centrifugal cutting disks.

The dryer is operable to generate powder waste. In other embodiments, the dryer may also have a mold positioned in its heating chamber. Such a mold may include a number of individual cavities configured to produce dried waste plugs during operation of the heating element with pulp disposed therein.

The liquid outlet of the waste separator is configured to be coupled to a residential drain. A filter may be used to prevent pulp from escaping the waste separator through the liquid outlet during operation of the motor-driven cutter.

According to another aspect, a domestic kitchen assembly includes a kitchen sink having a drain and a faucet operable to fill the kitchen sink with water. A waste separator is positioned under the kitchen sink and include (i) a waste inlet coupled to the drain of the kitchen sink, (ii) a motor-driven cutter operable to cut organic waste received through the waste inlet, (iii) a liquid outlet for dispelling water from the kitchen sink and liquid extracted from organic waste during operation of the motor-driven cutter, the liquid outlet being configured to be coupled to a drain, and (iv) a pulp outlet for dispelling pulp extracted from organic waste during operation of the motor-driven cutter. The pulp outlet is fluidly isolated from the liquid outlet. A dryer is coupled to the waste separator and includes (i) a pulp inlet coupled to the pulp outlet of the waste separator, (ii) a drying chamber positioned to receive pulp advanced through the pulp inlet, (iii) a heating element operable to heat and dehydrate pulp positioned in the drying chamber to generate dried solid waste, and (iv) a dried waste outlet for dispelling dried solid waste from the drying chamber.

A removable collection receptacle may be positioned to receive dried solid waste expelled from the dried waste outlet of the dryer.

The motor-driven cutter may be embodied as an augur or one or more centrifugal cutting disks.

The dryer is operable to generate powder waste. In other embodiments, the dryer may also have a mold positioned in its heating chamber. Such a mold may include a number of individual cavities configured to produce dried waste plugs during operation of the heating element with pulp disposed therein.

The liquid outlet of the waste separator is configured to be coupled to a residential drain. A filter may be used to prevent pulp from escaping the waste separator through the liquid outlet during operation of the motor-driven cutter.

According to another aspect, a method for processing organic waste from a kitchen sink includes advancing organic waste through a drain of the kitchen sink and into a waste separator positioned below the kitchen sink. A motor-driven cutter positioned in the waste separator is operated to generate pulp and a separated liquid from the organic waste. The pulp is advanced from the waste separator to a dryer. The separated liquid is drained from the waste separator to a drain via a fluid path which bypasses the dryer. The pulp is heated in the dryer to form a dried solid waste.

The dried solid waste may be advanced into a removable collection receptacle positioned below the dryer.

The dried solid waste may be powderized. The dried solid waste may be formed into solid waste plugs.

An augur may be operated to cut and squeeze organic waste to separate liquid therefrom and generate the pulp.

One or more centrifugal cutting disks may be operated to cut and squeeze organic waste to separate liquid therefrom and generate the pulp.

BRIEF DESCRIPTION OF THE DRAWINGS

The detailed description particularly refers to the following figures, in which.

DETAILED DESCRIPTION OF THE DRAWINGS

Figure 1:
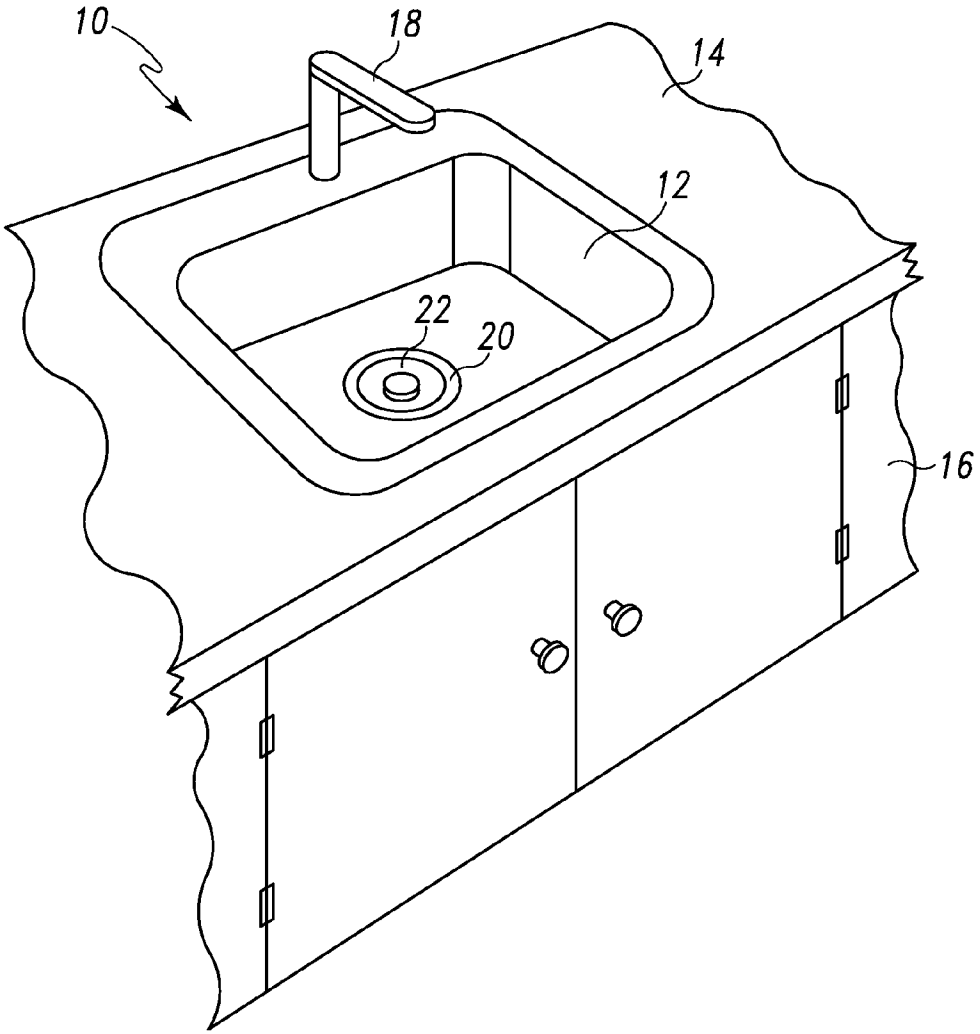
FIG. 1 is fragmentary perspective view of a kitchen sink installed in a kitchen cabinet.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, there is shown a domestic kitchen 10 such as the type found in a residential home. The domestic kitchen 10 includes a number of kitchen cabinets 16 which support a counter top 14 secured to the top thereof. A kitchen sink 12 is positioned in the counter top 14 in a conventional manner. A faucet 18 is operable to fill the kitchen sink 12 with water. Water exits the kitchen sink 12 through a drain 20. As can be seen in FIG. 1, a drain cap 22 maybe used to prevent water from draining out of the sink 12 and into the drain 20.

Figure 2:
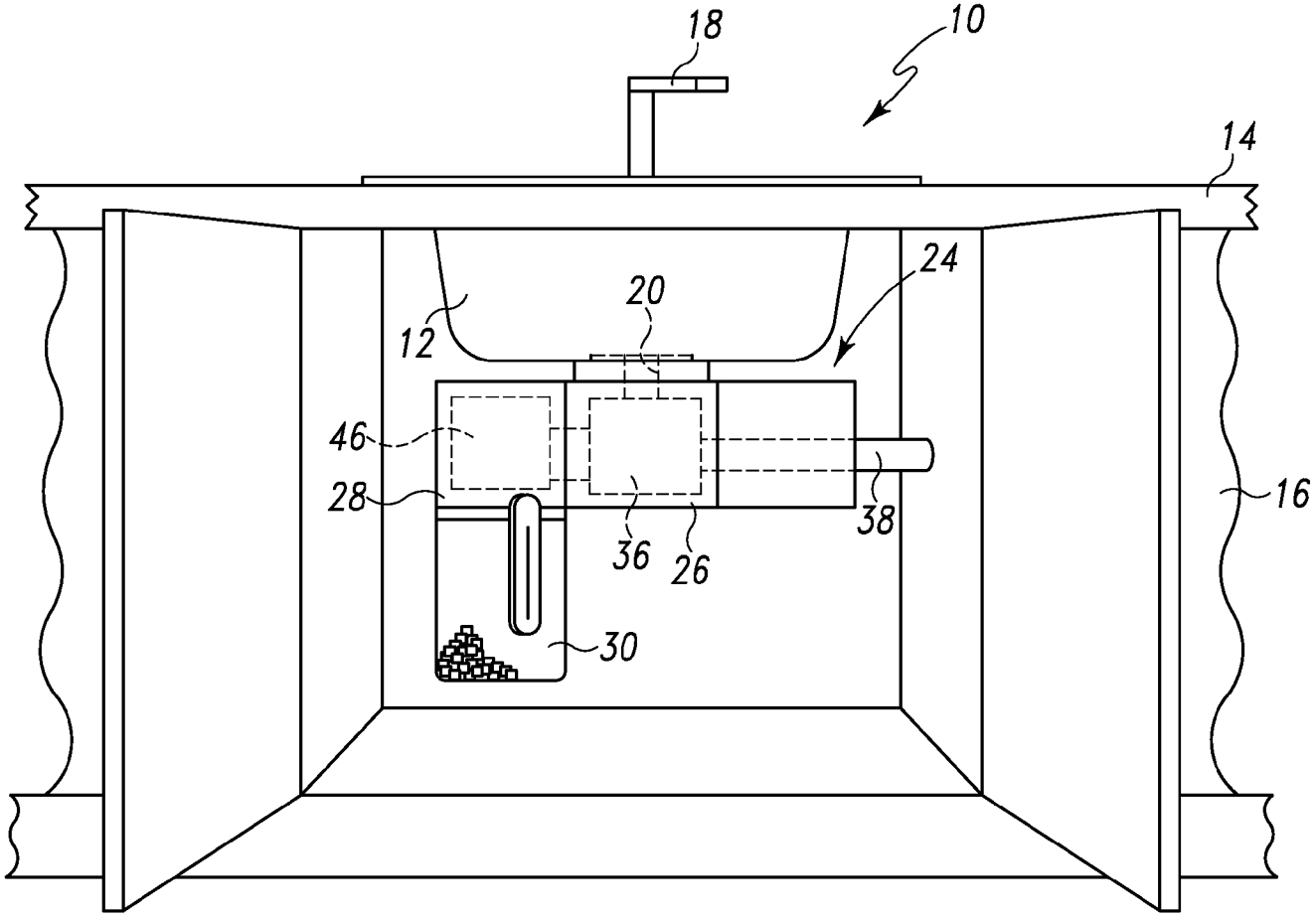
FIG. 2 is a fragmentary perspective view of a waste processing appliance installed under the sink of FIG. 1
Figure 3:
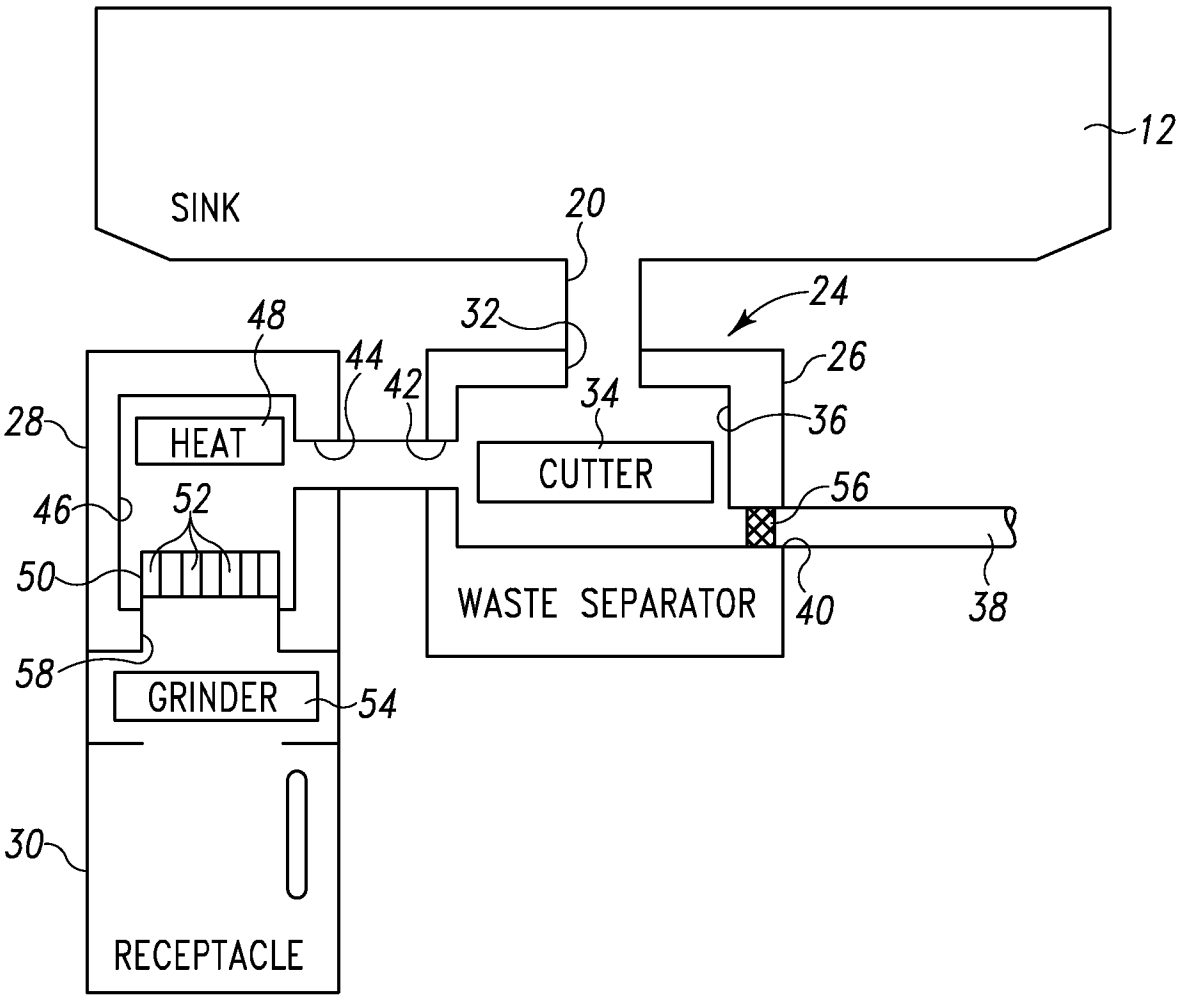
FIG. 3 is a block diagram of the waste processing appliance of FIG. 2.

Organic waste, such as kitchen scraps, may also be flushed through the drain 20 and thereafter processed by a waste processing appliance 24 as shown more clearly in FIGS. 2 and 3. As can be seen in FIG. 2, the waste processing appliance 24 includes three primary components, the first of which is a waste separator 26. The waste separator 26 is operable to process organic waste passed through the drain 20 of the kitchen sink 12 such that liquid is extracted therefrom and dispelled to a municipal drain. The pulp formed from the separated organic waste is advanced to the second primary component of the appliance, a dryer 28. The dryer 28 dries the organic waste pulp and thereafter dispels it in the form of dried organic waste to the remaining primary component of the appliance, a removable collection receptacle 30.

As noted above, processing of the organic waste by the appliance 24 starts when the organic waste (and presumably some amount of water from the faucet 18) is advanced through the sink's drain 20 and into a waste inlet 32 of the waste separator 26. A motor-driven cutter is operable to cut or otherwise process the organic waste received through the waste inlet 32. The motor-driven cutter 34 is positioned in a cutting chamber 36 of the waste separator 26. The waste separator 26 functions in a similar manner to a juicer appliance. Namely, the waste separator 26 cuts and squeezes organic waste to separate out the liquid from the waste, and, in doing so, forms a pulp. The separated liquid (along with any water from the faucet 18 drained from the sink 12) is drained to a residential drain line 38 through a liquid outlet 40. The separated pulp is dispelled through a pulp outlet 42 in the direction toward the dryer 28. A filter 56 prevents solids from escaping the waste separator 26 through the liquid outlet 40 and into the drain line 38.

As can be seen from FIGS. 2 and 3, the pulp outlet 42 and the liquid outlet are fluidly isolated from one another. As used herein, the term "fluidly isolated" means that the two outlets form different paths such that matter advancing through one port is prevented from passing through the other. As such, liquids (e.g., liquids separated from the organic waste or water) passing through the liquid outlet 40 are advanced along a fluid path that does not pass through the pulp outlet 42 (i.e., it bypasses the pulp outlet 42). Similarly, pulp dispelled through the pulp outlet 42 does not pass through the liquid outlet 40. In the case of the waste processing appliance 24, this is accomplished by the use of separate outlets (i.e., the liquid outlet 40 and the pulp outlet 42), both of which lead away from the cutting chamber 36. This is distinct from a designs where, for example, both solids and liquids pass through a common outlet and are subsequently separated by filtration.

As eluded to above, the cutting mechanism of the waste separator may leverage concepts similar to those used in domestic juicers. In such a way, the waste separator cuts and squeezes organic waste to separate out the liquid and in doing so forms a pulp not unlike a domestic juicer cuts and squeezes fruit to produce fruit juice and waste pulp. As such, the motor-driven cutter 34 may be embodied to include one or more augurs operable to cut and squeeze the organic waste thereby extracting the liquid from the organic waste and generating organic pulp. Alternatively, the motor-driven cutter 34 may include one or more centrifugal cutting discs which are operable to cut the organic waste and separate the liquid from it thereby generating organic pulp. Examples of augur-type cutting blades that may be used as the motor-driven cutter 34 (with or without some modification thereof) are found in U.S. Pat. No. 5,806,413 and U.S. Patent Application Publication No. 2009/0064875, both of which are hereby incorporated by reference. Other examples of augur-type cutters and centrifugal cutting disc-type cutters are found in numerous different designs of juicers.

The pulp outlet 42 of the waste separator is coupled to a pulp inlet 44 of the dryer 28. Organic pulp generated by the waste separator 26 advances through a pulp inlet 44 and into a drying chamber 46. A number of electric or gas heating elements 48 are operable to dry the organic pulp so as to generate solid organic waste. Once sufficiently dehydrated, the dried solid organic waste is advanced out of the drying chamber 46 via an waste outlet 58 and into the removable collection receptacle 30. It should be appreciated that the organic waste is subjected to a time and temperature within the drying chamber 46 such that it is sufficiently dehydrated beyond the point to support bacterial decomposition. In other words, the waste is dried sufficiently to prevent the organic waste from composting in the removable collection receptacle 30 thereby preventing unpleasant odors from being created.

One or more molds 50 may be positioned in drying chamber 46. Upon entry into the drying chamber 46, the organic pulp may be dispersed into the cavities 52 of the mold 50 and thereafter dried by operation of the heating elements 48. In such a way, dried waste plugs are produced and deposited into the removable collection receptacle 30.

Alternatively, or in addition to the use of the mold 50, a grinder 54 may be positioned in the drying chamber 46 or at a location between the drying chamber 46 and the removable collection receptacle 30. The grinder 54 may be used to powderize the dried organic waste (i.e., generate powder waste). In the case in which the grinder 54 is used in conjunction with the mold 50, the appliance 24 may be selectively operated to produce either plugs or powder much in the same way a domestic ice maker may be operated to produce either cubed or crushed ice. If the mold 50 is not used, the entirety of the dried organic waste is ground to powder prior to being advanced into the removable collection receptacle 30.

In operation, the waste processing appliance 24 is used to process organic waste, such as kitchen scraps, in a manner which mimics the ease of use of a conventional garbage disposal, but without passing solid wastes down a municipal drain line. This is especially useful in certain jurisdictions where the passage of processed (e.g., chopped) solid waste is prohibited by law. Moreover, the dried organic waste produced by the appliance 24 can be easily disposed of by either placing it in the garbage collection process, or, advantageously, using it as a compost material in a garden or flower bed.

The process begins when a user places organic waste in the kitchen sink 12. The organic waste is then flushed down the sink's drain 20 by the use of water from the faucet 18. The organic waste advances through the waste inlet 32 of the waste separator 26 and into the processing chamber 36. The motor-driven cutter 34 is operated to cut and squeeze the organic waste in the processing chamber 36. The cutter 34 may be sensor activated or manually engaged by the user's operation of a switch. Operation of the motor-driven cutter 34 separates (i.e., extracts) the liquid from the organic waste. This separated liquid, along with water from the sink 12, is then drained out of the processing chamber 36 and into a residential drain line 38 via the liquid outlet 40. The filter 56 prevents solids from escaping the waste separator 26 through the liquid outlet 40 and into the drain line 38.

The organic pulp generated as a result of extraction of the liquid from the organic waste by the waste separator 26 is advanced out of the processing chamber 36 through the pulp outlet 42. The organic pulp generated by the waste separator 26 then advances through the pulp inlet 44 of the dryer 28 and into its drying chamber 46. The incoming pulp is dispersed into the cavities 52 of the mold(s) 50 within the drying chamber.

The heating elements 48 are then operated to dry the organic pulp so as to generate solid organic waste. The time and temperature to which the organic waste is subjected within the drying chamber 46 is either predetermined or actively controlled (e.g., via a sensor-based control scheme) to ensure that the organic waste is sufficiently dehydrated beyond the point to support bacterial decomposition. As a result, the waste is dried sufficiently enough to prevent the organic waste from composting thereby preventing unpleasant odors from being created.

Once sufficiently dehydrated, the dried solid organic waste is advanced out of the drying chamber 46 via the waste outlet 58 and into the removable collection receptacle 30. Prior to being deposited in the removable collection receptacle 30, the dried organic waste may be powderized by use of the grinder 54 thereby generating a dried powder waste which is deposited into the removable collection receptacle 30.

The user may then remove the collection receptacle 30 and dump the collected dried waste in a suitable manner. For example, the dried plugs or powder may be dumped in an outdoor compost location. Gardens and flower beds are particularly useful areas to deposit powder waste. Alternatively, the collected waste may be dumped into a trash receptacle for pickup in the normal way.

Figure 4:
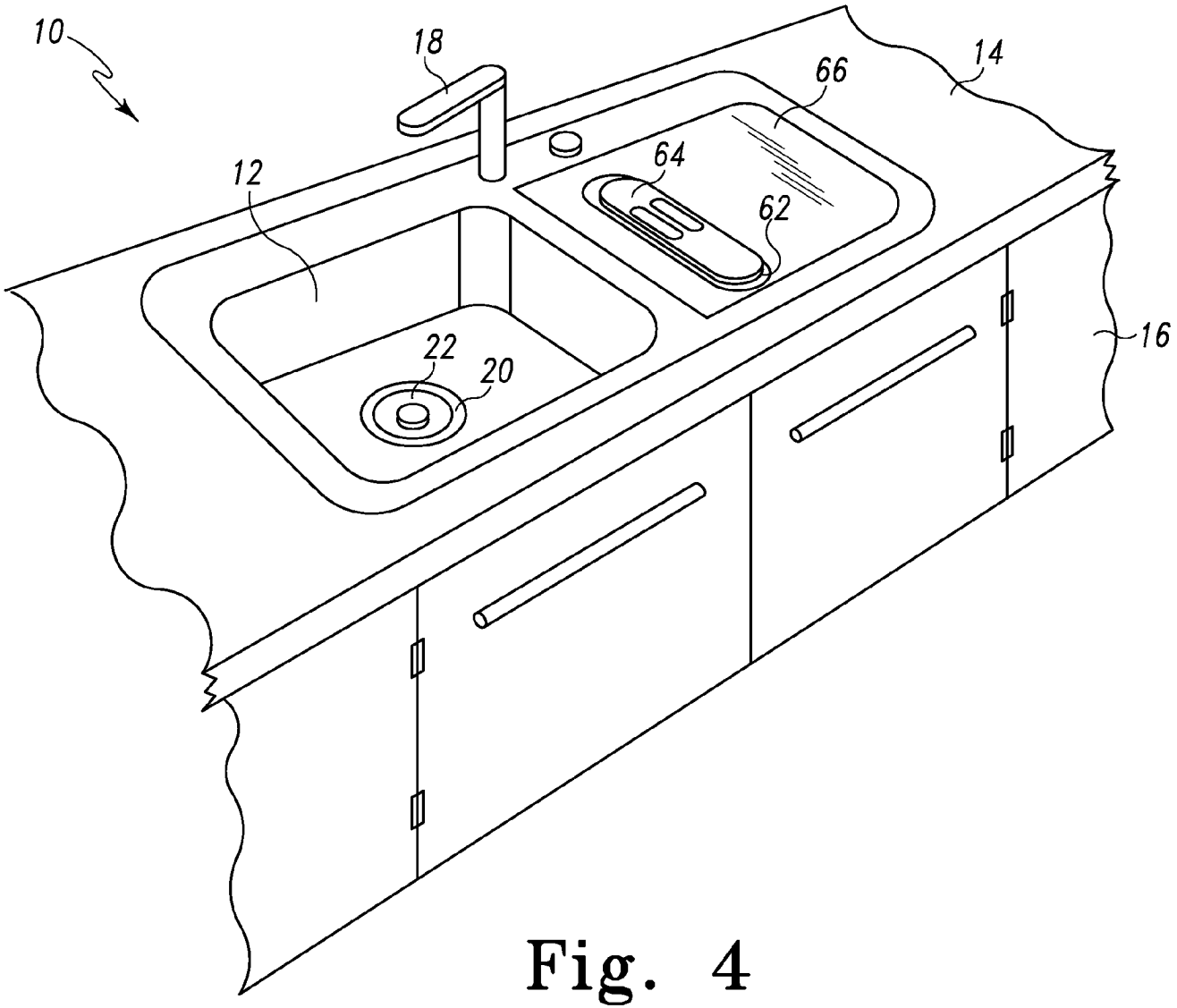
FIG. 4 is view similar to FIG. 1, but showing a second embodiment of a waste processing appliance.
Figure 5:
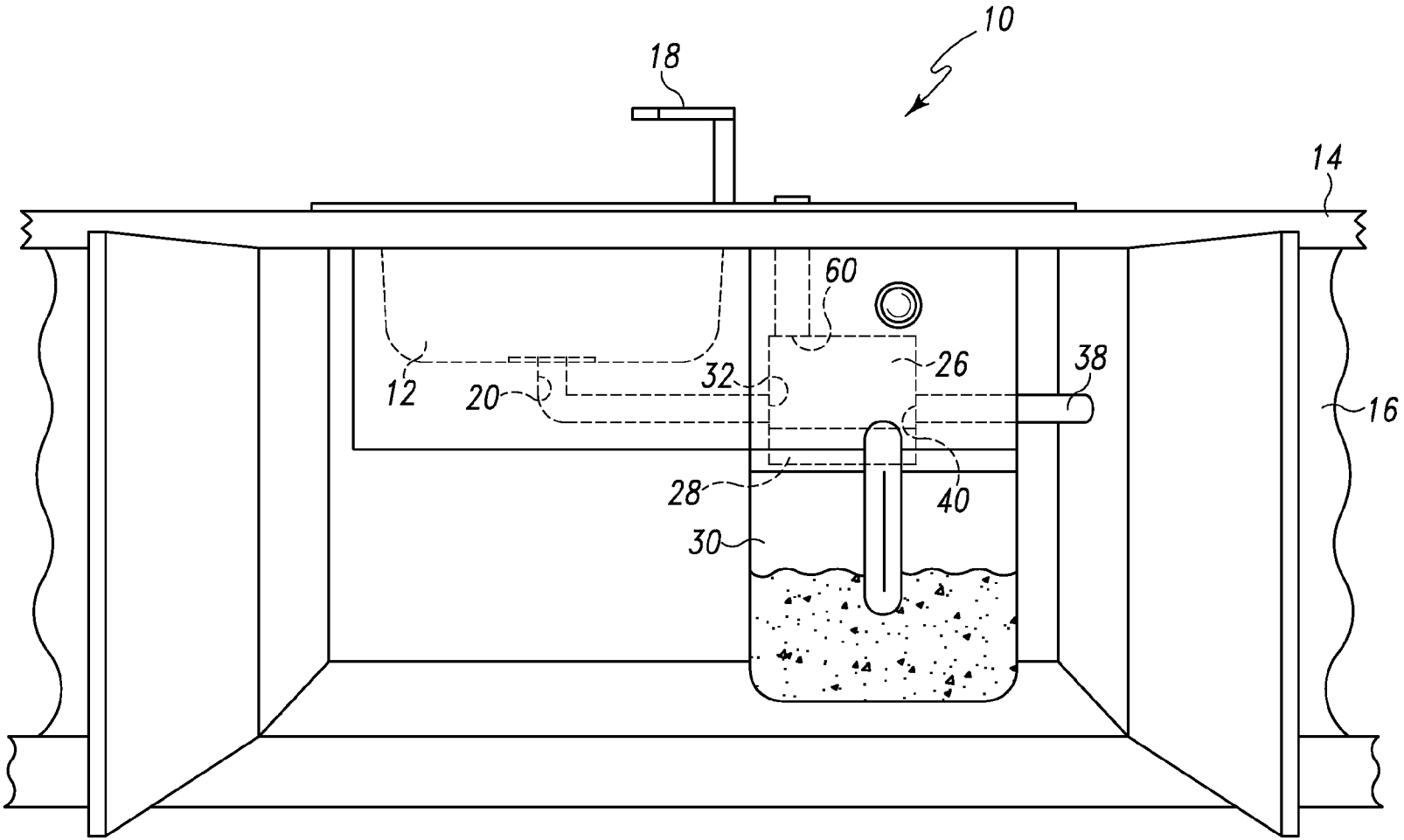
FIG. 5 is a view similar to FIG. 2, but showing the second embodiment of the waste processing appliance.

Referring now to FIGS. 4 and 5, there is shown an alternate embodiment of the waste processing appliance 24. The same reference numerals are used to designate similar components between the embodiment of FIGS. 1-3 and the embodiment of FIGS. 4 and 5. The waste processing appliance 24 of FIGS. 4 and 5 is essentially the same as the design of FIGS. 1-3 with the addition of a counter-top access location for disposing of large amounts of organic waste. In particular, the waste processing appliance of FIGS. 4 and 5 includes a second waste inlet port 60 which is coupled to an elongated waste-receiving slot 62 located on the counter top 14. A sealing cap 64 is positioned in the slot 62 when it is not in use. Large pieces of organic waste, such as large kitchen scraps, may be disposed of through the slot 62 and advanced to the waste separator 26 where they are processed in the same manner as described above in regard to the design of FIGS. 1-3. Organic waste passed through the sink's drain 20 are processed in a similar manner to as described above.

The design of FIGS. 4 and 5 is particularly useful for custom installations. For example, as shown in FIGS. 4 and 5, the disposal slot 62 may be surrounded by a food cutting and/or prep surface 66. Scraps from the cutting/prep process may be easily disposed through the slot 62 without having to be moved to the sink 12.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the apparatus, system, and method described herein. It will be noted that alternative embodiments of the apparatus, system, and method of the present disclosure may not include all of the features described yet still benefit from at least some of the advantages of such features. Those of ordinary skill in the art may readily devise their own implementations of the apparatus, system, and method that incorporate one or more of the features of the present invention and fall within the spirit and scope of the present disclosure as defined by the appended claims.

The invention claimed is:

1. An apparatus for processing organic waste from a sink positioned in a countertop, comprising:

a waste separator comprising (i) a first waste inlet coupled to a drain of the sink, (ii) a second waste inlet coupled to a waste-receiving slot located in the countertop, (iii) a motor-driven cutter operable to cut organic waste received through the first waste inlet and the second waste inlet, (iv) a liquid outlet for dispelling liquid extracted from organic waste during operation of the motor-driven cutter, and (v) a pulp outlet for dispelling pulp extracted from organic waste during operation of the motor-driven cutter, the pulp outlet being fluidly isolated from the liquid outlet, a dryer comprising (i) a pulp inlet coupled to the pulp outlet of the waste separator, (ii) a drying chamber positioned to receive pulp advanced through the pulp inlet, (iii) a heating element operable to heat and dehydrate pulp positioned in the drying chamber to generate dried solid waste, and (iv) a dried waste outlet for dispelling dried solid waste from the drying chamber, and a removable collection receptacle positioned to receive dried solid waste expelled from the dried waste outlet of the dryer.

2. The apparatus of claim 1, wherein the motor-driven cutter comprises an augur.

3. The apparatus of claim 1, wherein the motor-driven cutter comprises one or more centrifugal cutting disks.

4. The apparatus of claim 1, wherein the dryer is operable to generate powder waste.

5. The apparatus of claim 1, wherein the liquid outlet of the waste separator is configured to be coupled to a residential drain.

6. The apparatus of claim 1, wherein the waste separator further comprises a filter to prevent pulp from escaping the waste separator through the liquid outlet during operation of the motor-driven cutter.

7. A domestic kitchen assembly, comprising:

a kitchen sink positioned in a countertop, the kitchen sink having a drain, a faucet operable to fill the kitchen sink with water, a waste separator comprising (i) a first waste inlet coupled to the drain of the kitchen sink, (ii) a second waste inlet coupled to a waste-receiving slot located in the countertop, (iii) a motor-driven cutter operable to cut organic waste received through the first waste inlet and the second waste inlet, (iv) a liquid outlet for dispelling water from the kitchen sink and liquid extracted from organic waste during operation of the motor-driven cutter, the liquid outlet being configured to be coupled to a drain, and (v) a pulp outlet for dispelling pulp extracted from organic waste during operation of the motor-driven cutter, the pulp outlet being fluidly isolated from the liquid outlet, and a dryer comprising (i) a pulp inlet coupled to the pulp outlet of the waste separator, (ii) a drying chamber positioned to receive pulp advanced through the pulp inlet, (iii) a heating element operable to heat and dehydrate pulp positioned in the drying chamber to generate dried solid waste, and (iv) a dried waste outlet for dispelling dried solid waste from the drying chamber.

8. The kitchen assembly of claim 7, further comprising a removable collection receptacle positioned to receive dried solid waste expelled from the dried waste outlet of the dryer.

9. The kitchen assembly of claim 7, wherein the motor-driven cutter comprises an augur.

10. The kitchen assembly of claim 7, wherein the motor-driven cutter comprises one or more centrifugal cutting disks.

11. The kitchen assembly of claim 7, wherein the dryer is operable to generate powder waste.

12. The kitchen assembly of claim 7, wherein the waste separator further comprises a filter to prevent pulp from escaping the waste separator through the liquid outlet during operation of the motor-driven cutter.

13. A method for processing organic waste from a kitchen sink positioned in a countertop, comprising:

advancing organic waste through a drain of the kitchen sink and into a waste separator positioned below the kitchen sink, advancing organic waste through a waste receiving slot located in the countertop and into the waste separator, operating a motor-driven cutter positioned in the waste separator to generate pulp and a separated liquid from the organic waste, advancing the pulp from the waste separator to a dryer, draining the separated liquid from the waste separator to a drain via a fluid path which bypasses the dryer, and heating the pulp in the dryer to form a dried solid waste.

14. The method of claim 13, further comprising advancing the dried solid waste into a removable collection receptacle positioned below the dryer.

15. The method of claim 13, wherein heating the pulp comprises heating the pulp in the dryer to form solid waste powder.

16. The method of claim 13, wherein operating the motor-driven cutter comprises operating an augur to cut and squeeze organic waste to separate liquid therefrom and generate the pulp.

17. The method of claim 13, wherein operating the motor-driven cutter comprises operating one or more centrifugal cutting disks to cut and squeeze organic waste to separate liquid therefrom and generate the pulp.

* * * * *